US006667680B1

(12) United States Patent
Gibson et al.

(10) Patent No.: US 6,667,680 B1
(45) Date of Patent: Dec. 23, 2003

(54) CIRCUIT BREAKER

(75) Inventors: Jeffrey S. Gibson, Hookstown, PA (US); Craig A. Rodgers, Butler, PA (US); Lance Gula, Clinton, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/185,858

(22) Filed: Jun. 27, 2002

(51) Int. Cl.[7] ..... H01F 9/00
(52) U.S. Cl. ..... 336/172; 336/167
(58) Field of Search ..... 335/23–25, 167–172, 335/201; 200/400, 401

(56) References Cited

U.S. PATENT DOCUMENTS 4,687,891 A 8/1987 Bartolo et al.
5,430,422 A * 7/1995 Gibson ..... 335/172
5,931,289 A 8/1999 Chou
6,204,465 B1 * 3/2001 Gula et al. ..... 218/154
6,492,607 B2 * 12/2002 Bruckert et al. ..... 200/401

* cited by examiner

*Primary Examiner*—Tuyen T. Nguyen
(74) *Attorney, Agent, or Firm*—Martin J. Moran

(57) ABSTRACT

A circuit breaker includes a handle having OFF, ON and intermediate positions, and an extension. A blocking disk has a spring, and first, second and third surfaces. The handle and disk are co-pivotally mounted. The extension engages the third surface for rotation therewith. A pivot lever includes a first end adapted for engagement with a movable contact arm, and a second end adapted for engagement with the first and second surfaces. The first surface blocks the second end as the handle moves from OFF toward the intermediate position, and releases the second end to the second surface at the intermediate position. The first end blocks movement of the movable contact arm when the first surface blocks the second end, and releases the movable contact arm when the first surface releases the second end, thereby moving a movable contact toward a fixed contact in response to the bias of a spring.

6 Claims, 10 Drawing Sheets

CIRCUIT BREAKER

CROSS-REFERENCE TO RELATED APPLICATION

This application is related to commonly assigned, concurrently filed U.S. patent application Ser. No. 10/185,560, filed Jun. 27, 2002, entitled "Circuit Breaker Including Two Circuit Breaker Mechanisms And An Operating Handle".

BACKGROUND OF THE INVENTION

1. Field of the Invention

This invention relates to electrical switching apparatus and, more particularly, to circuit breakers having one or more pairs of separable contacts.

2. Background Information

Circuit breakers are used to protect electrical circuitry from damage due to an overcurrent condition, such as an overload condition or a relatively high level short circuit or fault condition. In small circuit breakers, commonly referred to as miniature circuit breakers, used for residential and light commercial applications, such protection is typically provided by a thermal-magnetic trip device. This trip device includes a bimetal, which heats and bends in response to a persistent overcurrent condition. The bimetal, in turn, unlatches a spring powered operating mechanism, which opens the separable contacts of the circuit breaker to interrupt current flow in the protected power system.

"Slow make" is defined as the closing velocity of the circuit breaker separable contacts being directly dependent upon the closing speed of the operating handle. For a circuit breaker operating at relatively high voltages (e.g., 480 to 600 VAC), this results in a greater tendency for the separable contacts to weld closed, and significantly reduces the number of switching operations in the operating life of the circuit breaker.

There is room for improvement in circuit breakers.

SUMMARY OF THE INVENTION

The present invention is directed to a circuit breaker in which a first end of an operating mechanism pivot lever blocks movement of a movable contact arm when a surface of an operating handle blocks the other end of the pivot lever, and in which the first end of the pivot lever releases the movable contact arm when the surface of the operating handle releases the other end of the pivot lever as the operating handle is moved to an intermediate position thereof. In turn, the movable contact arm and its movable contact rapidly rotate toward a fixed contact in response to the bias of an operating mechanism spring.

An accordance with the invention, a circuit breaker comprises: a housing; a fixed contact; an operating mechanism including a movable contact arm pivotally mounted thereto and a spring, the movable contact arm having a movable contact adapted for engagement with the fixed contact, the spring biasing the movable contact arm and the movable contact toward the fixed contact; an operating handle having an OFF position, an ON position, and an intermediate position between the OFF and ON positions, the operating handle including a handle member having an extension; a blocking member having a bias member, a first surface, a second surface and a third surface, the handle member and the blocking member being co-pivotally mounted to the housing, the extension of the handle member engaging the third surface of the blocking member for rotation therewith; a pivot lever including a first end adapted for engagement with the movable contact arm, and including a second end adapted for engagement with the first and second surfaces of the blocking member, the first surface of the blocking member blocking the second end of the pivot lever as the operating handle is moved from the OFF position toward the intermediate position thereof, and the first surface of the blocking member releasing the second end of the pivot lever to the second surface of the blocking member as the operating handle is moved to the intermediate position thereof, wherein the first end of the pivot lever blocks movement of the movable contact arm when the first surface of the blocking member blocks the second end of the pivot lever, and wherein the first end of the pivot lever releases the movable contact arm when the first surface of the blocking member releases the second end of the pivot lever as the operating handle is moved to the intermediate position thereof, thereby moving the movable contact arm and the movable contact toward the fixed contact in response to the bias of the spring.

When the fixed and movable contacts are welded closed, the second end of the pivot lever may engage the extension of the operating handle and limit rotation of the operating handle from the intermediate position to the OFF position.

The blocking member may be a blocking disk. The first surface may be a first diameter of the blocking disk, the second surface may be a second diameter of the blocking disk, and the third surface may be between the first and second surfaces. As the operating handle is moved from the OFF position toward the intermediate position thereof, the extension of the handle member may engage the third surface of the blocking disk for movement therewith. The first end of the pivot lever may release the movable contact arm when the first diameter of the blocking disk releases the second end of the pivot lever to the second diameter of the blocking disk as the operating handle is moved to the intermediate position thereof.

The pivot lever may include a first arm having the first end and a second arm having the second end. As the operating handle is moved from the ON position toward the intermediate position thereof, the extension of the handle member may engage the second arm of the pivot lever and pivot the first arm and the first end of the pivot lever to engage the movable contact arm for movement of the movable contact thereof away from the fixed contact.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a three-phase molded case circuit breaker 2. It will become evident that the invention is applicable to other types of circuit breakers, such as single-phase or plural-phase miniature circuit breakers, and to a wide range of circuit breaker applications, such as, for example, residential, commercial, industrial, aerospace, and automotive.

Figure 1:
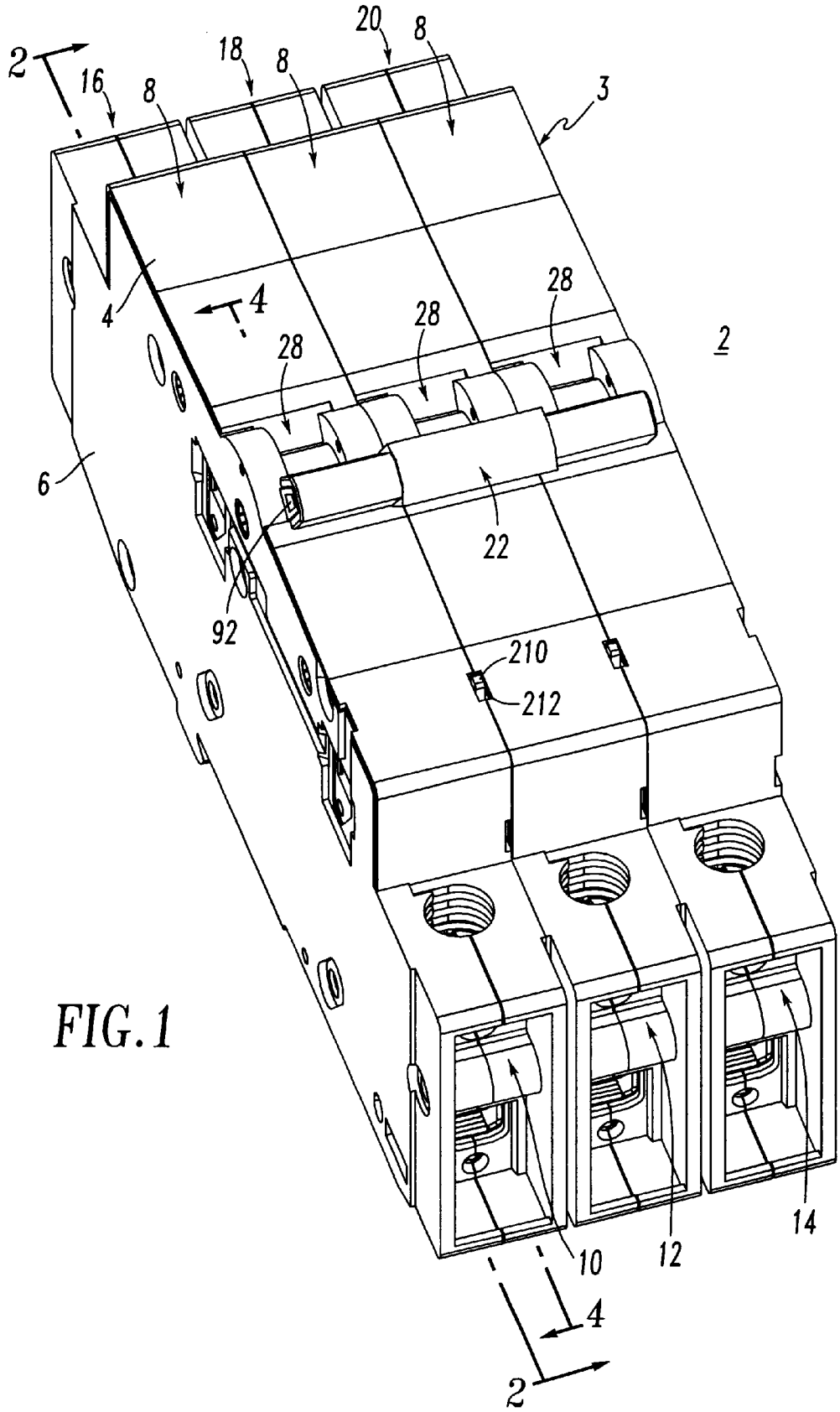
FIG. 1 is an isometric view of a circuit breaker in accordance with the present invention.

FIG. 1 shows the exemplary three-phase molded case circuit breaker 2 including an electrically insulated housing 3 comprising a molded base 4 and a similarly molded cover 6 for each of three poles. The molded base 4 and molded cover 6 form a molded case 8 for each of the three poles. For the three poles, three load terminals 10,12,14 and three line terminals 16,18,20 are provided, where load terminal 10 is related to line terminal 16, load terminal 12 is related to line terminal 18, and load terminal 14 is related to line terminal 20. A common or ganged handle assembly 22 manually opens and closes the exemplary three-phase circuit breaker 2.

Figure 2A:
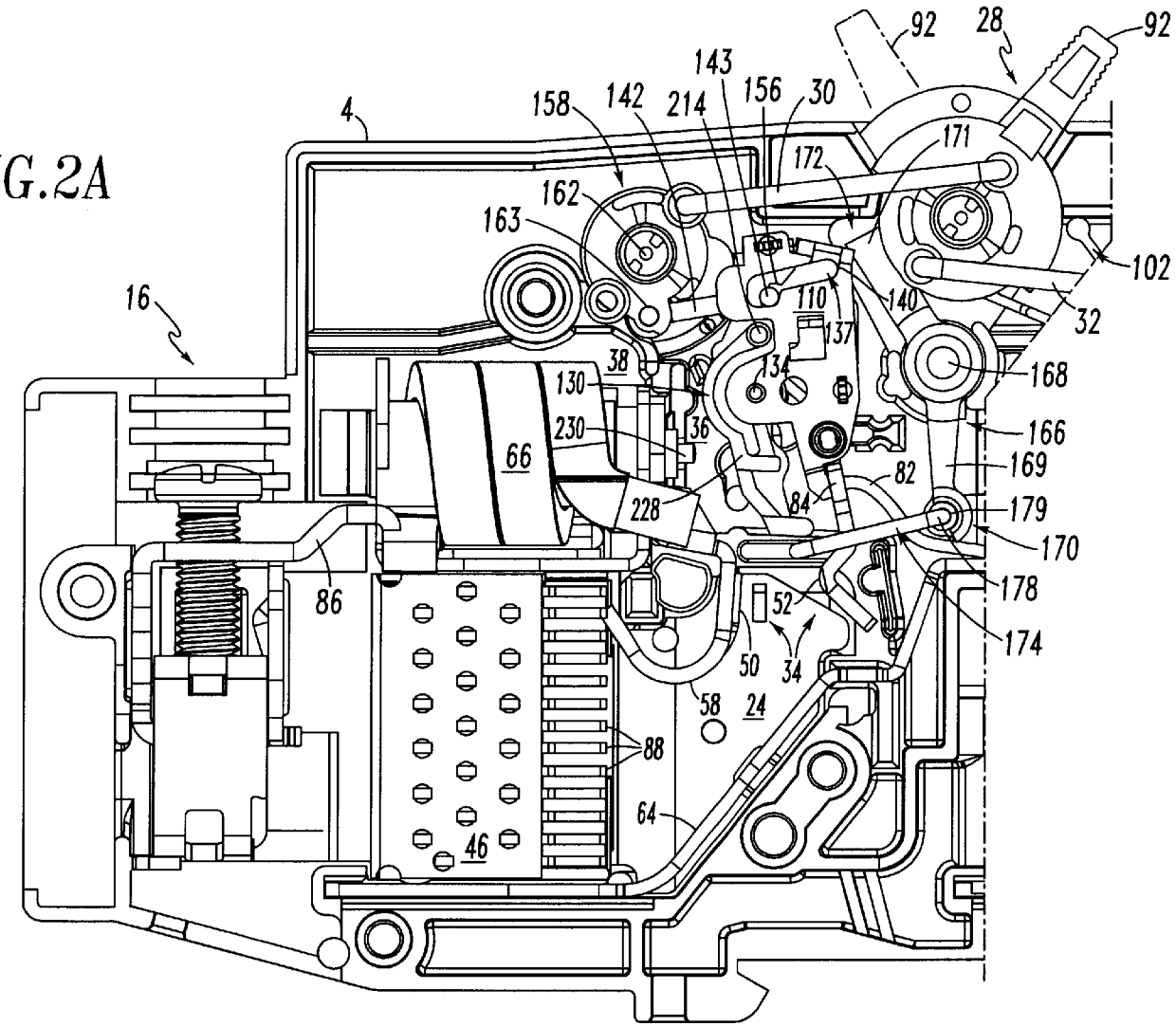
FIGS. 2A–2B, when placed end-to-end, form a cross sectional view along lines 2—2 of one pole of the circuit breaker of FIG. 1 with the operating handle assembly in the OFF position.
Figure 2B:
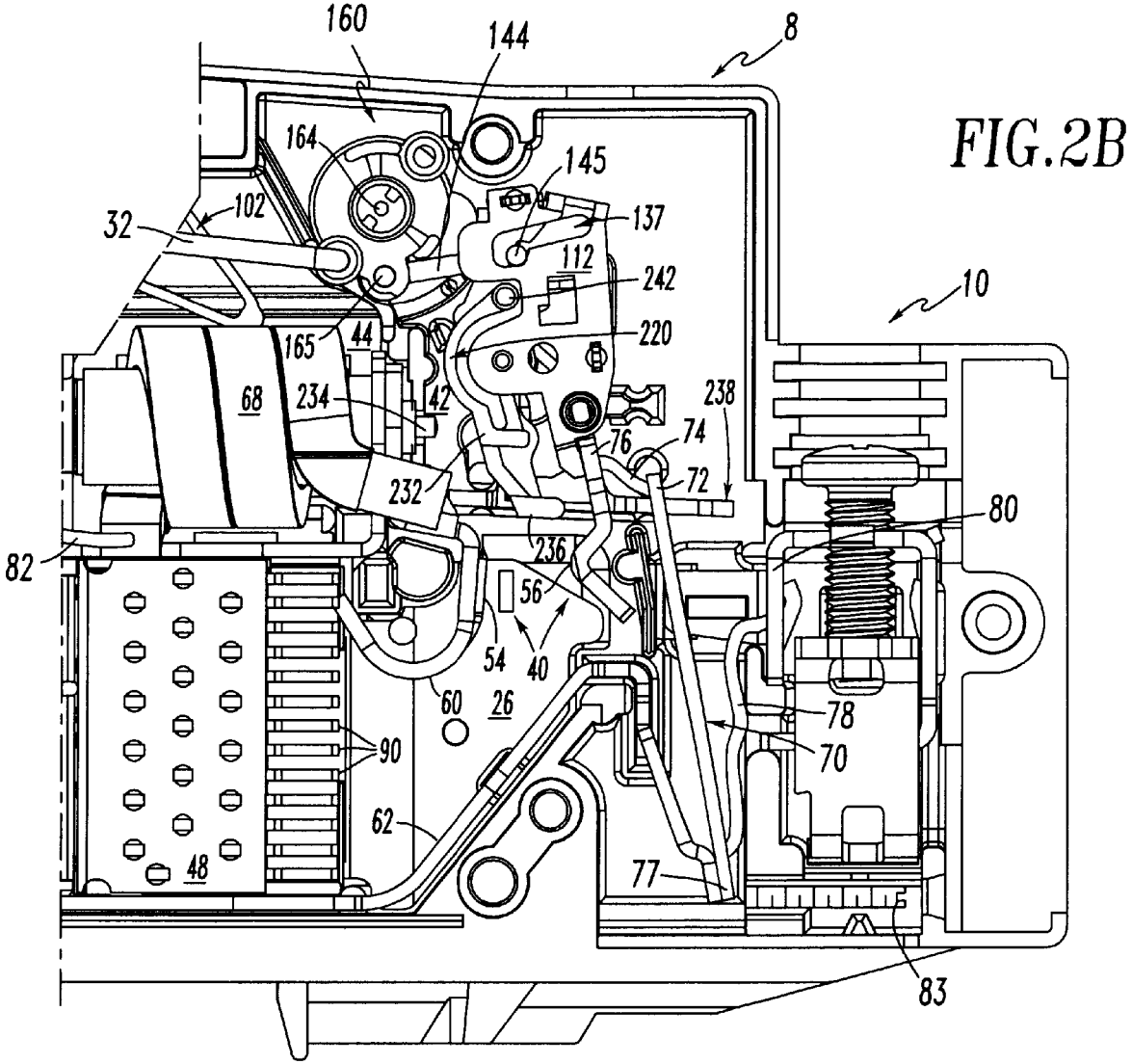

Referring to FIGS. 2A–2B, each pole of the circuit breaker 2 includes the molded base 4, a load terminal, such as 10, a line terminal, such as 16, a first circuit breaker mechanism 24, a second circuit breaker mechanism 26, and an operating handle assembly 28 for the pole, which handle is shown in the OFF position. A first U-shaped link 30 is disposed from the operating handle assembly 28 to the first circuit breaker mechanism 24, and a second link U-shaped 32 is disposed from the operating handle assembly 28 to the second circuit breaker mechanism 26. The first circuit breaker mechanism 24 includes a first set of separable contacts 34 (shown open), a first operating mechanism 36 for moving the first separable contacts 34 between the open position and a closed position (shown in FIG. 5), and a first trip mechanism 38 cooperating with the first operating mechanism 36 for moving the first separable contacts 34 from the closed position to the open position thereof Similarly, the second circuit breaker mechanism 26 includes a second set of separable contacts 40 (shown open) in series with the first separable contacts 34 between the line terminal 16 and the load terminal 10, a second operating mechanism 42 for moving the second separable contacts 40 between the open position and a closed position (shown in FIG. 5), and a second trip mechanism 44 cooperating with the second operating mechanism 42 for moving the second separable contacts 40 from the closed position to the open position thereof.

The single operating handle assembly 28 of the circuit breaker pole is advantageously tied to the two circuit breaker mechanisms 24,26 (through first and second secondary pivots 158,160 as discussed below) by the links 30,32, respectively. In the exemplary embodiment, the two circuit breaker mechanisms 24,26 are housed in series in the single pole molded case 8 and are arranged for operation in the same direction, with the "load" side of the first mechanism 24 being electrically connected to the "line" side of the downstream second mechanism 26. Thus, the upstream mechanism 24 provides the line terminal 16 of this pole and the downstream mechanism 26 provides the load terminal 10 of the pole.

The first and second links 30,32 engage the first and second operating mechanisms 36,42 to move the first and second separable contacts 34,40, respectively, between the corresponding closed and open positions thereof responsive to the ON and OFF positions, respectively, of the operating handle assembly 28.

Disposed within the molded case 8 are first and second arc chutes 46,48, which are operatively associated with the first and second separable contacts 34,40, respectively. The first set of separable contacts 34 includes a fixed contact 50 and a movable contact 52. Similarly, the second set of separable contacts 40 includes a fixed contact 54 and a movable contact 56. The first arc chute 46 is operatively associated with a first arc runner 58 extending from the first fixed contact 50. Similarly, the second arc chute 48 is operatively associated with a second arc runner 60 extending from the second fixed contact 54, and a third arc runner 62, which is electrically interconnected (through a bimetal element 70 as discussed below) with the load terminal 10. A fourth arc runner 64 is operatively associated with and provides an electrically conducting path between the two arc chutes 46,48.

The circuit breaker mechanisms 24,26 are provided within the molded case 8 for interconnection between the line terminal 16 and the load terminal 10 as discussed below. The first circuit breaker mechanism 24 includes the first fixed contact 50 and the first movable contact 52, and the second circuit breaker mechanism 26 includes the second fixed contact 54 and the second movable contact 56. The fixed contacts 50,54 are preferably welded on the arc runners 58,60, respectively.

The exemplary first and second trip mechanisms 38,44 include magnetic trip coils 66,68, respectively, to provide corresponding instantaneous magnetic trip functions. Although two trip coils 66,68 are shown, the invention is applicable to circuit breakers employing a single trip coil (not shown). Also, the second trip mechanism 44 further includes the bimetal element 70 to provide a thermal trip function. The bimetal element 70 has an input or free end 72 electrically interconnected by a flexible shunt 74 with the second movable contact 56 through a corresponding second movable contact arm 76. The bimetal element 70 also has an output or base 77, which is electrically interconnected by a flexible shunt 78 with a load conductor 80 of the load terminal 10. Another flexible shunt 82 electrically connects a first movable contact arm 84 to the fourth arc runner 64 and to the input of the second magnetic trip coil 68. Preferably, the bimetal element 70 also includes an adjustment screw 83 to adjust a thermal trip threshold thereof. The movable contacts 52,56 are suitably plated (e.g., silver) on the respective movable contact arms 84,76, which are movably operable relative to the respective fixed contacts 50,54 depending on the status of the corresponding circuit breaker mechanisms 24,26. The movable contact arm 76, for example, has the movable contact 56 adapted for engagement with the corresponding fixed contact 54. Similarly, the movable contact arm 84 has the movable contact 52 adapted for engagement with the corresponding fixed contact 50.

Both of the magnetic trip coils 66,68 are preferably active and provide instantaneous magnetic trip functions for the respective circuit breaker mechanisms 24,26. In this manner, the most effective current limiting capability is provided. Since the magnetic trip coils 66,68 act independently and since common activation currents are very difficult to achieve, a common trip actuator 206 (FIG. 7) is employed between the two circuit breaker mechanisms 24,26.

Although the exemplary embodiment employs a single bimetal element 70 with the second circuit breaker mechanism 26, a bimetal element (not shown) may alternatively be employed with the first circuit breaker mechanism 24. Although one bimetal element is preferred, two bimetal elements (not shown) may be employed with both circuit breaker mechanisms 24,26.

The first magnetic trip coil 66 is electrically interconnected between the line terminal 16 and the first fixed contact 50 by a line conductor 86 of the line terminal 16 at one end and the first arc runner 58 at the other end of the coil 66. The second magnetic trip coil 68 is electrically interconnected between the first movable contact 52 and the second fixed contact 54 by the flexible shunt 82 at one end and the second arc runner 60 at the other end of the coil 68.

An electrical circuit between the line terminal 16 and the load terminal 10 is formed by the series combination of the line conductor 86 from the line terminal 16, the first magnetic trip coil 66, the first arc runner 58, the first fixed contact 50, the first movable contact 52 (in the closed position of FIG. 5), the first movable contact arm 84, the flexible shunt 82, the second magnetic trip coil 68, the second arc runner 60, the second fixed contact 54, the second movable contact 56 (in the closed position of FIG. 5), the second movable contact arm 76, the flexible shunt 74, the bimetal element 70, the flexible shunt 78, and the load conductor 80 to the load terminal 10.

The first arc chute 46 is electrically positioned between: (a) the arc runner 58 for the first fixed contact 50 at the output of the first magnetic trip coil 66, and (b) the arc runner 64 and the input of the second magnetic trip coil 68. The second arc chute 48 is electrically positioned between: (a) the arc runner 60 for the second fixed contact 54 at the output of the second magnetic trip coil 68, and (b) the arc runner 62 and the output or base 77 of the bimetal element 70. The arc chutes 46,48 include a plurality of conventional spaced deionization plates 88,90.

The exemplary circuit breaker 2, thus, employs a series arrangement of the two circuit breaker mechanisms 24,26. The interruption performance of the circuit breaker 2 is determined by the "current limitation of series arcs," which provides two arcs in series, thereby having twice the resistance of a single arc. In the exemplary embodiment, IEC 898 component circuit breaker mechanisms are employed. This exemplary configuration allows for a UL 480 VAC (and perhaps a 600 VAC) device capable of 65 kA interruption in an 18 mm per pole width.

The enhanced current limiting capability provided by the circuit breaker 2 increases the likelihood for Type 2 protection. Such protection provides that equipment so classified can be returned to regular service after exposure to its listed short circuit withstand. No part or component within the system requires replacement prior to continued operation.

Figure 3:
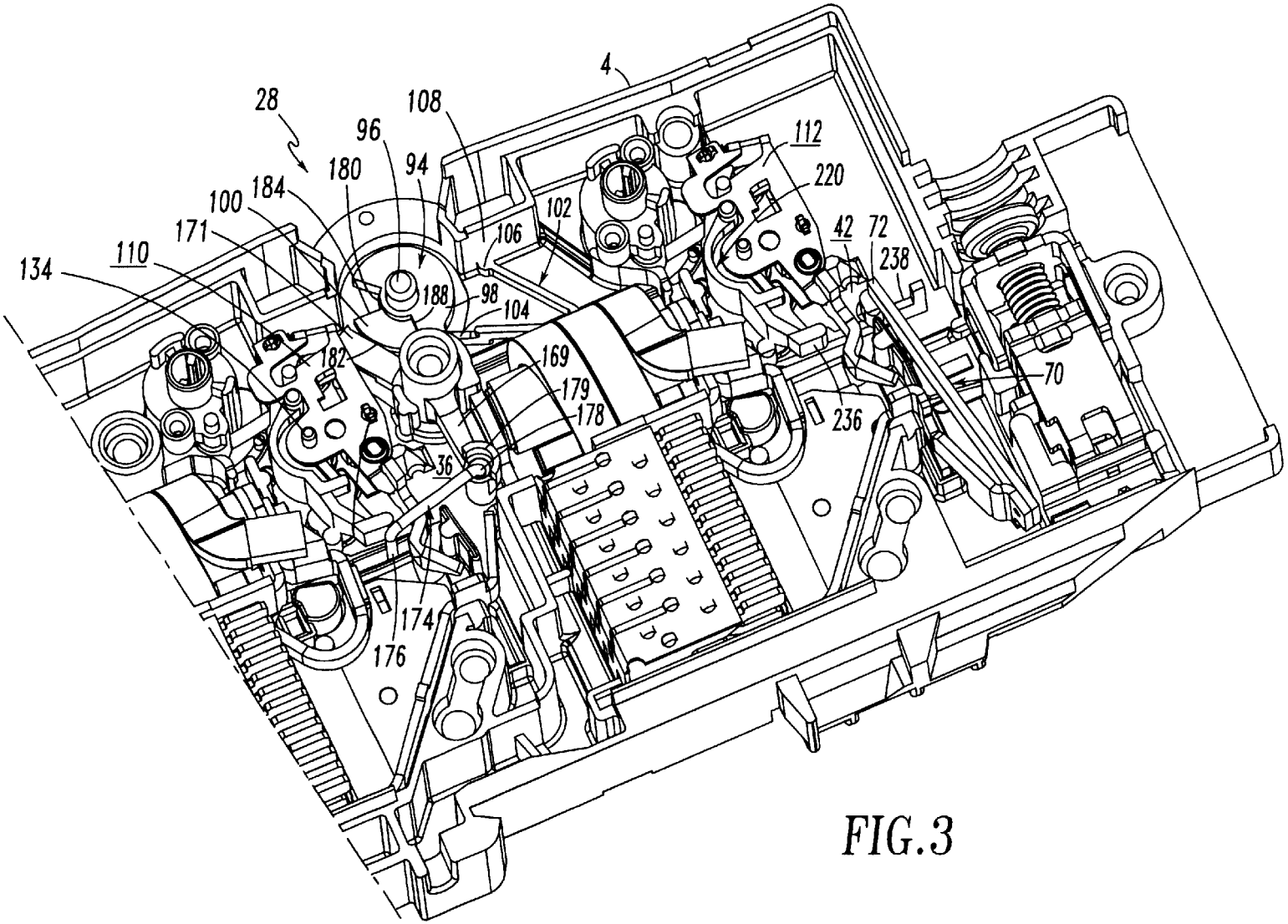
FIG. 3 is an isometric view, similar to the cross sectional view of a portion of FIG. 2A and FIG. 2B, but with the operating handle assembly cut away to show the blocking disk.

Also referring to FIG. 3, the operating handle assembly 28 includes an operating handle 92 (FIG. 2A) and a blocking disk 94 (FIG. 3), both of which are co-pivotally mounted by a pivot mechanism 96 related to the molded base 4. The secondary pivots 158,160 include a spring (not shown) which biases the operating handle 92 toward the OFF position of FIG. 2A. The blocking disk 94 is preferably molded to include a first portion 98 and a second portion 100. The first portion 98 (and, thus, the second portion 100 and the blocking disk 94) is biased to resist counterclockwise rotation with respect to FIGS. 2A–2B and 3. The bias may be provided by employing cantilever spring member 102 having a first end 104 disposed from the first blocking disk portion 98 and a second end 106 loaded against a surface 108 of the molded base 4. Alternatively, a torsion spring (not shown) may be employed.

Figure 6C:
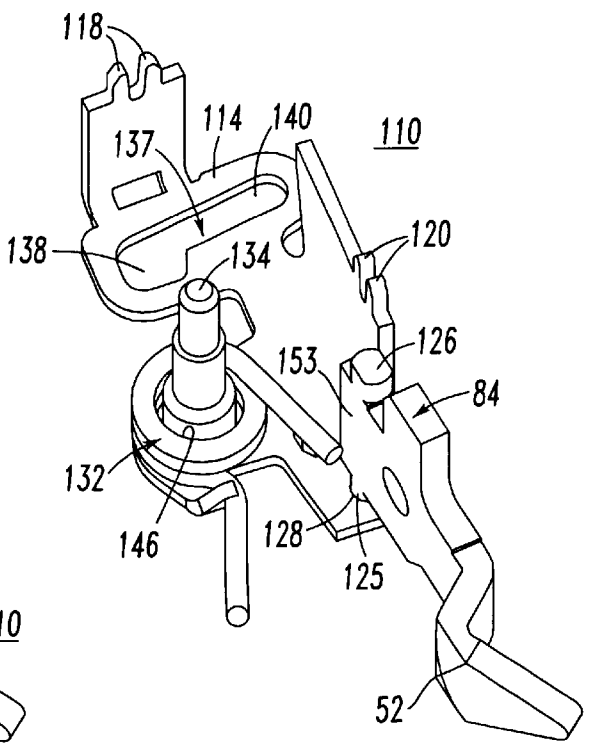
FIG. 6C PRIOR ART
FIG. 6C is an isometric view, similar to FIG. 6B, but with the carrier cover removed.
Figure 6B:
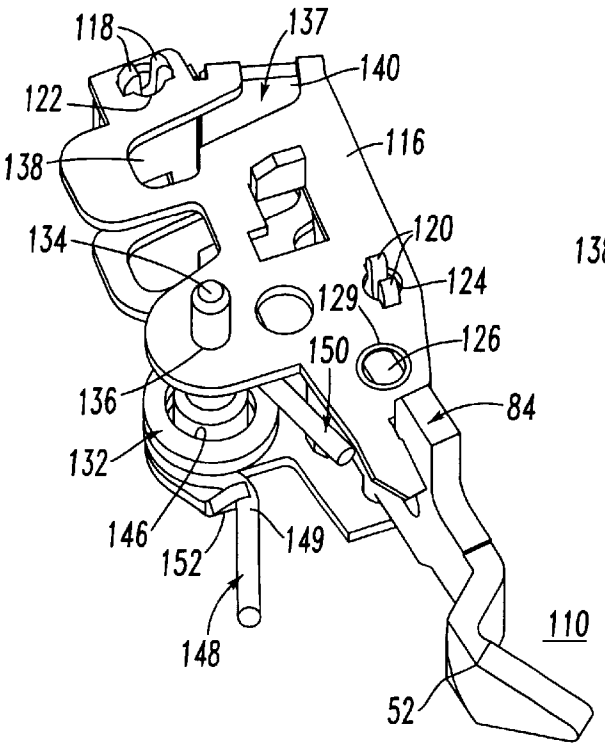
FIG. 6B PRIOR ART
FIG. 6B is an isometric view, similar to FIG. 6A, but with the latch member removed to show the carrier spring.
Figure 6A:
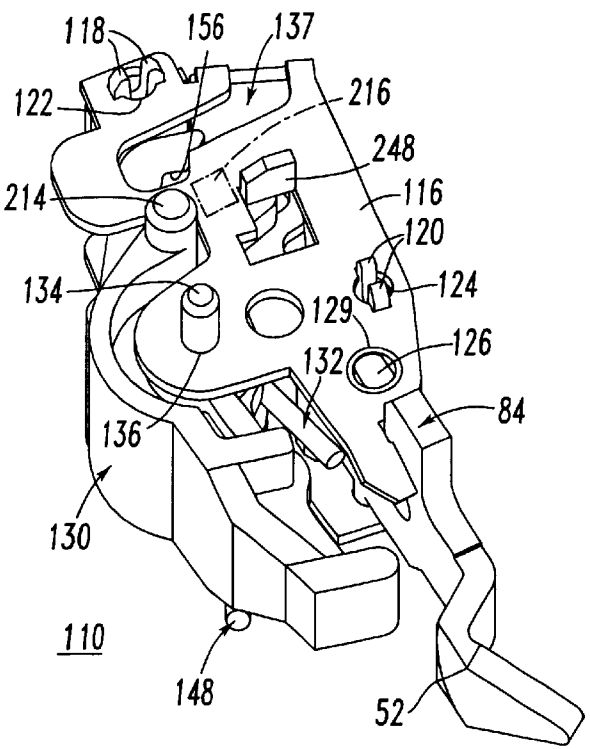
FIG. 6A PRIOR ART
FIG. 6A is an isometric view of the carrier mechanism of FIG. 2A.

The operating mechanisms 36,42 further include carrier mechanisms 110,112, respectively. As shown in FIGS. 6A–6C, the carrier mechanism 110 of the first operating mechanism 36 includes a base portion 114 and a cover portion 116. The base and cover portions 114,116 are secured together by two sets of fingers 118,120 of the base portion 114, which engage the cover portion 116 at respective openings 122,124 thereof. The movable contact arm 84 is pivotally mounted to the carrier mechanism 110 by pivots 125 and 126, which are pivotally mounted in an opening 128 of the base portion 114 and an opening 129 of the cover portion 116, respectively.

The carrier mechanism 110 also includes a latch member 130 and a spring 132. The latch member 130 is pivotally mounted to the carrier mechanism 110 by a post 134, an upper end of which extends through an opening 136 of the cover portion 116. A lower end 135 (shown in FIGS. 4 and 5) of the post 134 extends through a corresponding opening 135A (shown in FIGS. 4 and 5 of the carrier base portion 114. In turn, the lower post end 135 is pivotally mounted in an opening (not shown) of the molded base 4 of FIG. 3. The carrier mechanism 110 further includes a channel 137 formed in the base portion 114 and the cover portion 116. The channel 137 has a first end 138 and an opposite second end 140. As discussed below, the pivotally mounted latch member 130 is employed for releasing the carrier mechanism 110 in response to a trip condition of the circuit breaker 2.

As shown in FIGS. 2A–2B, the channel 137 accepts a U-shaped link 142 with an end 143 being disposed in the first end 138 of the channel 137 of the first carrier mechanism 110. Similarly, a U-shaped link 144 having an end 145 is disposed in the first end 138 of the channel 137 of the second carrier mechanism 112. As discussed below, the links 142,144 provide linkages from the respective carrier mechanisms 110,112 through the secondary pivots 158,160 to the operating handle assembly 28.

Referring again to FIGS. 6A–6C, the spring 132 has an opening 146, a first end 148 and a second end 150. The post 134 of the latch member 130 passes through the spring opening 146. A bend portion 149 proximate the first spring end 148 engages a notch 152 of the carrier base portion 114, and the second spring end 150 engages a surface 153 of the movable contact arm 84 in order to bias such arm clockwise with respect to FIG. 6C. The link 142 is engaged by the hook member 156 of the latch member 130, which permits the carrier mechanism 110 to rotate with the operating handle assembly 28. The carrier spring 132 further interacts with the molded base 4 to provide counterclockwise (with respect to FIG. 2A) bias to open the carrier mechanism 110 upon release of the latch member 130.

A spring (not shown) associated with the secondary pivot 160 (FIG. 2B) biases the operating handle 92 off and biases the upper portion of the latch member 130 clockwise (with respect to FIG. 6A) to hold the link end 143 in the first end 138 of the channel 137. As discussed below, the latch member 130 is adapted to pivot counter-clockwise with respect to FIG. 6A in response to a trip condition to release the link end 143 toward the second end 140 of the channel 137. Hence, the latch member 130 releases the link 142 in response to a trip condition.

Figure 4:
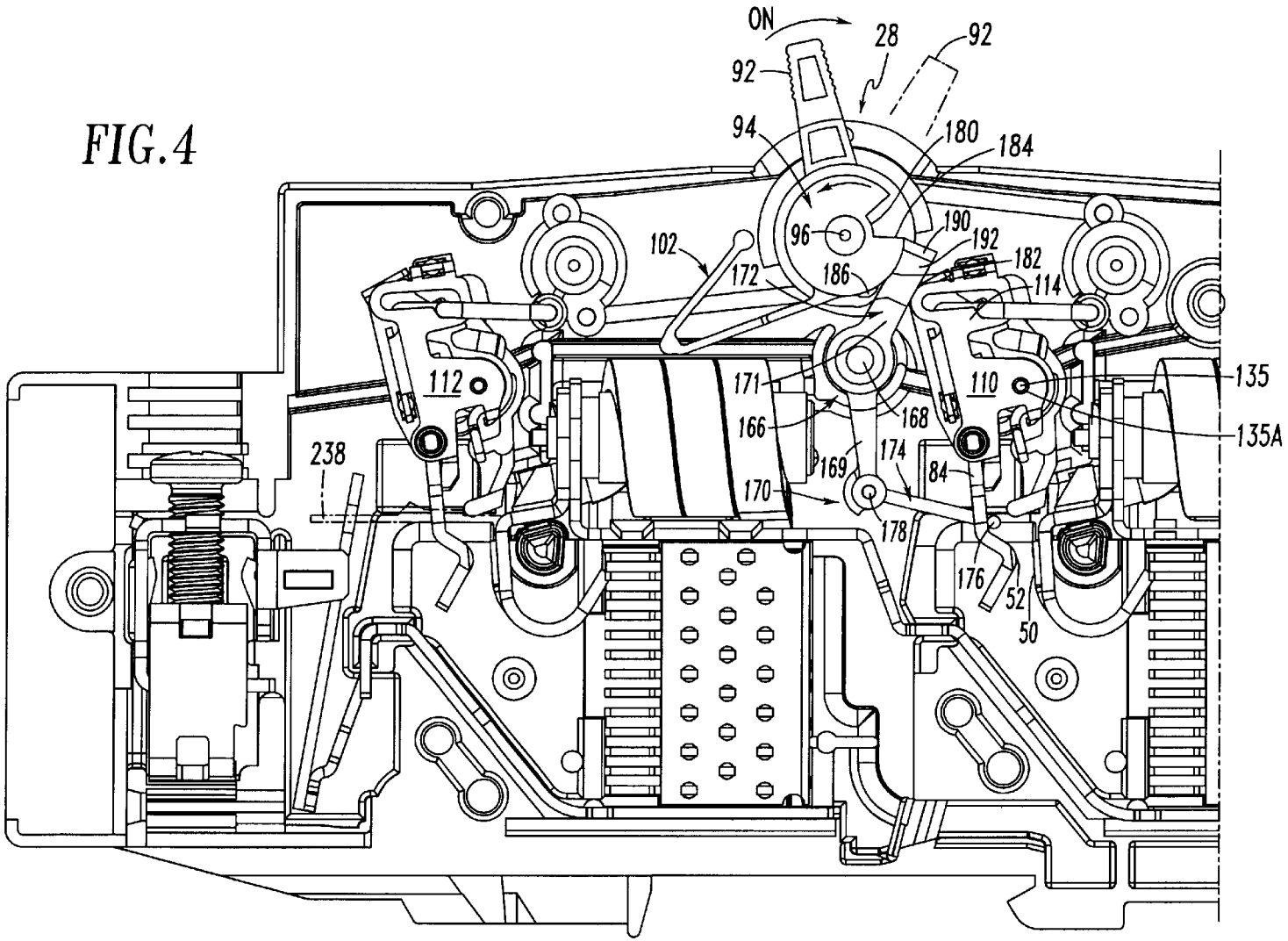
FIG. 4 is a reverse cross sectional view along lines 4—4 of one pole of the circuit breaker of FIG. 1 with the operating handle assembly in a blocking position.
Figure 5:
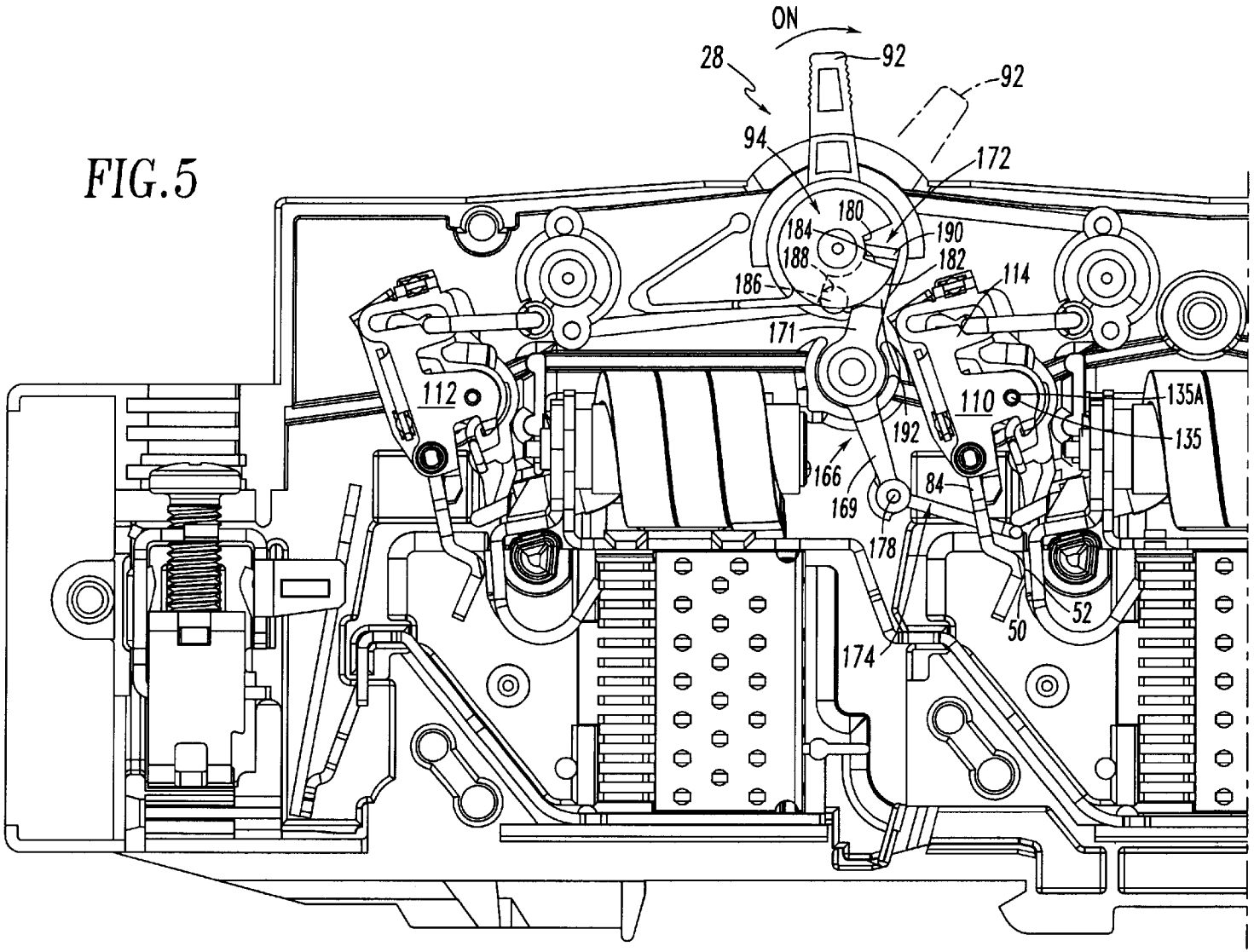
FIG. 5 is a view similar to FIG. 4, but with the operating handle assembly in a snap close position.

Referring to FIGS. 2A–2B and 3–5, the operating handle 92 has an OFF position (FIG. 2A), an ON position (shown in phantom line drawing in FIG. 2A), and first and second intermediate positions (shown in FIGS. 3 and 4, and FIG. 5) between the OFF and ON positions. As shown in FIGS. 2A, 4 and 5, the operating handle assembly 28 is rotated counter-clockwise (with respect to FIG. 2A) toward the ON position (as shown in phantom line drawing in FIG. 2A). The operating handle assembly 28, in turn, drives the operating mechanisms 36,42 through the links 30,32, which rotate the secondary pivots 158,160, respectively, counter-clockwise (with respect to FIGS. 2A–2B). The pivots 158,160 are pivotally mounted to the molded base 4 by respective pins 162,164. The opposite secondary pivot ends 163,165 of the links 142,144 are pivotally mounted in openings of the pivots 158,160, respectively. Similarly, first ends of the links 30,32 are pivotally mounted in corresponding openings of the operating handle assembly 28, and second ends of the links 30,32 are pivotally mounted in corresponding openings of the respective pivots 158,160.

As shown with the operating mechanism 36, the first secondary pivot 158, in turn, drives the link 142, which drives the carrier mechanism 110 clockwise (with respect to FIG. 2A) about the post 134. As discussed above in connection with FIGS. 6A–6C, the carrier mechanism 110 carries the movable contact arm 84 having the movable contact 52 disposed at the free end thereof. Solely with this arrangement, as disclosed above, the slower that the user rotates the operating handle assembly 28 into the ON position, the slower the carrier mechanism 110 drives the movable contact arm 84, in order to contact the fixed contact 50 with the movable contact 52. It will be appreciated that the second operating mechanism 42, the second secondary pivot 160, the links 32 and 144, the second carrier mechanism 112, and the second separable contacts 40 operate in an analogous manner.

A pivot lever 166 is pivotally mounted to the molded base 4 by a pin 168. The pivot lever 166 includes a first arm 169 having a first end 170 adapted for engagement with the movable contact arm 84, and a second arm 171 having a second end 172 adapted for engagement with the operating handle assembly 28. The first end 170 of the pivot lever 166 carriers a U-shaped hook member 174 pivotally disposed thereon. The hook member 174 has a J-shaped hook 176 (shown in FIG. 3), which hook is adapted for engagement with the movable contact arm 84, and a J-shaped pivot end 178, which is pivotally mounted in an opening 179 of the first arm 169.

In order to eliminate the dependency between the movable contact arm 84 and the operating handle assembly 28, the hook 176 of the hook member 174 initially hooks the movable contact arm 84 (as shown in FIG. 4). The pivot end 178 of the hook member 174 is inserted into the first or free end 170 of the pivot lever 166. The pivot lever 166 pivots about the pin 168 and translates the hook member 174 and the movable contact arm 84 movement up to the operating handle assembly 28. The second or handle end 172 of the pivot lever 166 interacts with the blocking disk 94 (FIG. 5) of the operating handle assembly 28, which disk rotates about the same center as the operating handle 92, but is allowed independent movement.

This independent movement of the operating handle 92 and the blocking disk 94 of the operating handle assembly 28 provides a resetable snap close function. As shown in FIGS. 3 and 4, the blocking disk 94 includes two diameters or surfaces 180,182 having an abrupt radius transition or surface 184 therebetween. The blocking disk 94 is continuously biased clockwise (with respect to FIGS. 2A and 3) and counter-clockwise (with respect to FIGS. 4 and 5) by the spring 102. This forces the large diameter 182 to block the handle end 172 of the pivot lever 166 from clockwise rotation (with respect to FIGS. 2A and 3, and, thus, from counter-clockwise rotation with respect to FIG. 4). As shown in the blocking position of FIG. 4, the pivot lever 166 and the hook member 174 block the movable contact arm 84 from rotating with the carrier mechanism 110 as the operating handle assembly 28 is turned (clockwise with respect to FIG. 4) to the ON position of the operating handle 92 (shown in phantom line drawing in FIG. 4).

As shown in FIGS. 4 and 5, this blocking condition (FIG. 4) exists until the operating handle assembly 28 is further turned clockwise (with respect to FIG. 5) toward the ON position of the operating handle 92 (shown in phantom line drawing in FIG. 5), at which time the blocking disk 94 is forced to rotate with the operating handle assembly 28 by the dowel or extension 186 (FIG. 4) of the operating handle 92, which dowel engages the radius or surface 188 of the blocking disk 94. As the blocking disk 94 is rotated further counter-clockwise with respect to FIGS. 2A and 3 by the operating handle dowel 186, the blocking disk 94 rotates clockwise with respect to FIGS. 4 and 5 against the bias of the spring 102. As shown in FIG. 5, this rotation causes the large diameter 182 of the blocking disk 94 to abruptly transition to the smaller diameter 180 at the end portion 190 of the handle end 172 of the pivot lever 166.

The line of force exerted through the drive lines 142,144 on the respective secondary pivots 158,160 passes through the pivot center of such pivots as the operating handle 92 approaches the ON position. The previous clockwise bias (with respect to FIGS. 2A–2B) of the secondary pivots 158,160 changes to a counterclockwise bias (with respect to FIGS. 2A–2B), which tends to keep the operating handle 92, as connected through the links 142,144, in the ON position.

The first surface or large diameter 182 of the blocking disk 94 blocks the end 190 of the pivot lever 166 as the operating handle assembly 28 is moved from the OFF position (FIG. 2A) toward the intermediate non-blocking position (FIG. 5) thereof That large diameter 182 releases the pivot lever end 190 to the second surface or small diameter 180 as the operating handle assembly 28 is moved to the intermediate position (FIG. 5) thereof. As shown in FIG. 4, the hook member 174 of the pivot lever 166 blocks movement of the movable contact arm 84 when the large diameter 182 blocks the pivot lever end 190. In turn, the hook member 174 of the pivot lever 166 releases (FIG. 5) the movable contact arm 84 when the large diameter 182 releases the pivot lever end 190 as the operating handle assembly 28 is moved to the intermediate position (FIG. 5) thereof, thereby allowing movement of the movable contact arm 84 and the movable contact 52 toward the fixed contact 50 in response to the bias of the carrier mechanism spring 132 (FIGS. 6A–6C).

As shown in FIG. 5, once the abrupt radius transition 184 rotates past the end portion 190 to the recessed portion 192 of the pivot lever handle end 172, the pivot lever 166 is, then, allowed sufficient counter-clockwise (with respect to FIG. 5) motion and the movable contact arm 84, which was previously held stationary by the hook member 174, snaps to close the movable contact 52 onto the fixed contact 50. During the blocking operation (FIG. 4), the movable contact arm 84 pivots counter-clockwise (with respect to FIGS. 6A–6C) in the carrier mechanism 110 and, thus, the closing force for the separable contacts 34 is directed clockwise with respect to FIG. 2A (and counter-clockwise with respect to FIG. 5) due to the carrier spring 132.

In the exemplary embodiment, the snap close function (from FIG. 4 to FIG. 5) is provided with the hook member 174, the carrier mechanism 110 and the movable contact arm 84. Since no blocking function is provided with the exemplary second carrier mechanism 112 and its movable contact arm 76, the second separable contacts 40 close before the first separable contacts 34.

As the circuit breaker 2 is turned OFF or trips open, the dowel 186 (FIG. 4) of the operating handle 92 rotates the pivot lever 166 (clockwise with respect to FIG. 4) to clear the large diameter 182 of the blocking disk 94. Once this has occurred (FIG. 4), the bias (shown as counter-clockwise in FIG. 4) of the spring 102 drives the blocking disk 94 back to its original position (FIG. 3), thereby resetting it for another close operation.

The interaction between the operating handle assembly 28 and the pivot lever 166 also advantageously acts as a position ON indication. In the event that the separable contacts 50,52 have welded closed, when turning the operating handle 92 to the OFF position, the pin 186 (FIG. 4) engages the second arm 171 of the pivot lever 166, which is prevented from rotating through hook member 174. Hence, it is not possible to bring the operating handle assembly 28 back to the position of FIG. 4 without the application of excessive force.

Figure 7:
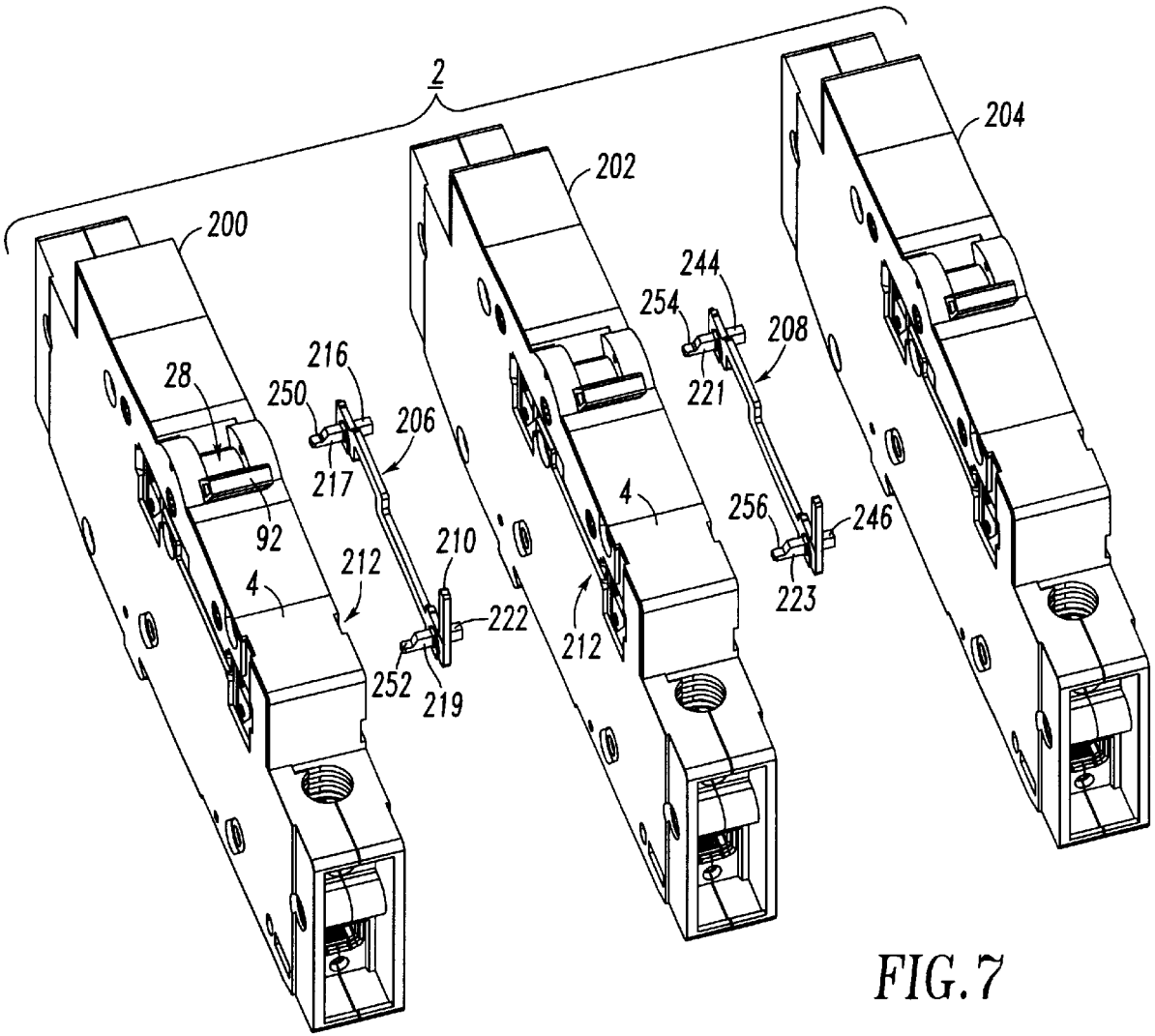
FIG. 7 is an exploded isometric view of three circuit breaker poles and two trip actuators for each pair of the circuit breaker poles.
Figure 8:
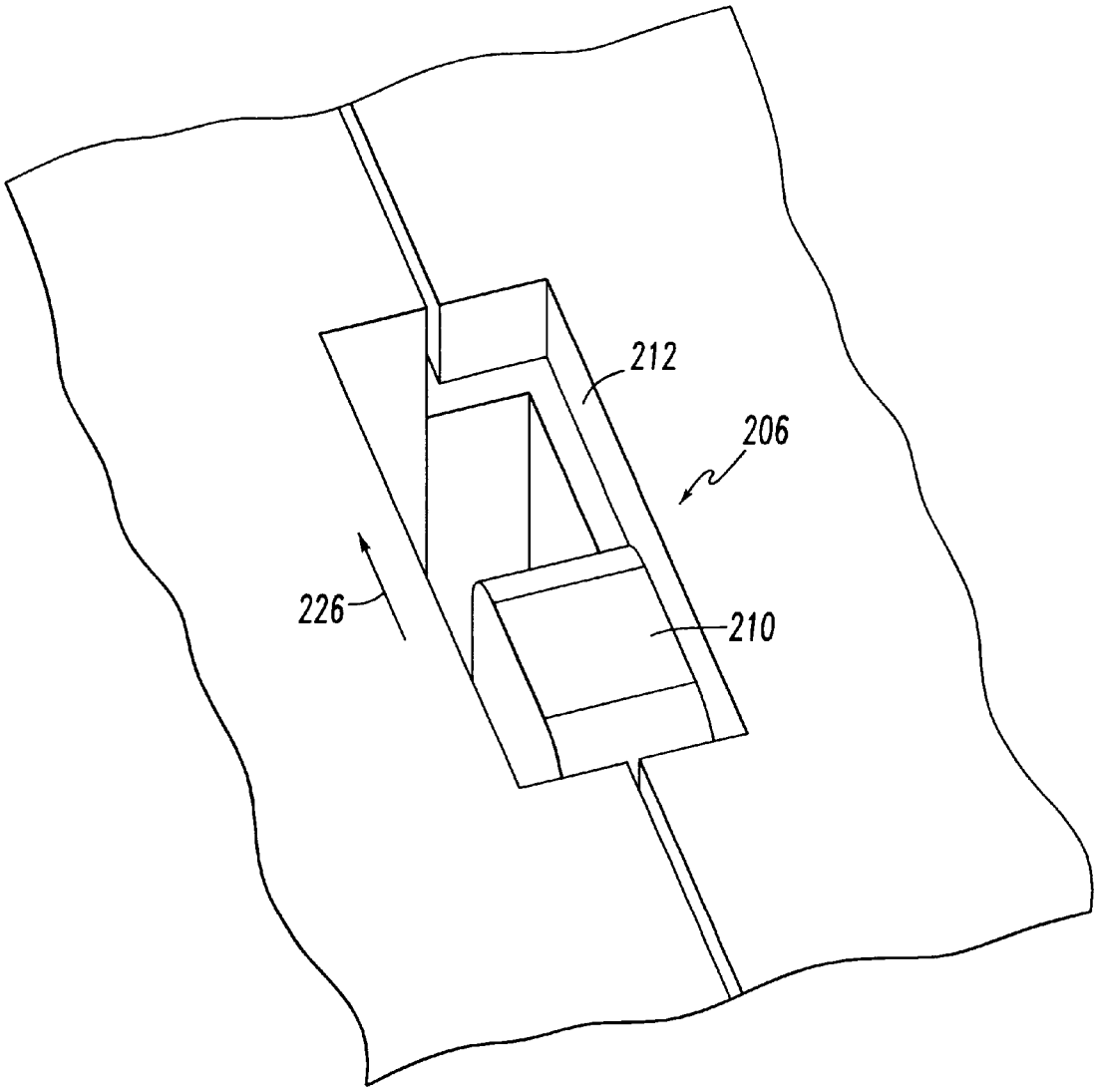
FIG. 8 is an isometric view of the push-to-trip pushbutton of one of the trip actuators of FIG. 7.

FIG. 7 shows the circuit breaker 2 of FIG. 1 constructed by stacking three single pole circuit breakers 200,202,204, which employ two trip actuators 206,208 therebetween. The circuit breakers 202,204 are preferably identical to the circuit breaker 200 as discussed in connection with FIGS. 2A–2B, 3–5, 6A–6C and 9 herein. As shown in FIG. 8, each of these trip actuators, as shown with actuator 206, has a push-to-trip pushbutton 210, which is engaged by one of the trip actuators 206,208 of FIG. 7. The push-to-trip pushbutton 210 is disposed through an opening 212 formed between adjacent molded bases 4 of the single pole circuit breakers 200,202. The trip actuator 206 extends toward the face of the exemplary circuit breaker 2 and engages the manual trip button 210 (FIG. 8) to facilitate manual trip testing.

Referring again to FIG. 2A, the latch member 130 of the carrier mechanism 110 is adapted to pivot (counter-clockwise with respect to FIG. 2A) in response to various trip conditions, in order to release the end 143 of the link 142 toward the second end 140 of the carrier channel 137 and, thus, trip the circuit breaker mechanism 24 and, in turn, the circuit breaker 2. As shown in FIG. 6A, the upper end projection 214 of the latch member 130 of circuit breaker 202 is adapted for engagement by a projection 216 (shown in phantom line drawing in FIG. 6A) of the trip actuator 206, which is external to the circuit breakers 200,202 of FIG. 7. In a related manner, an upper end projection 242 (FIG. 2B) of the latch member 220 of the second carrier mechanism 112 of circuit breaker 202 is adapted for engagement by a projection 222 (FIG. 7) of the trip actuator 206.

Figure 9:
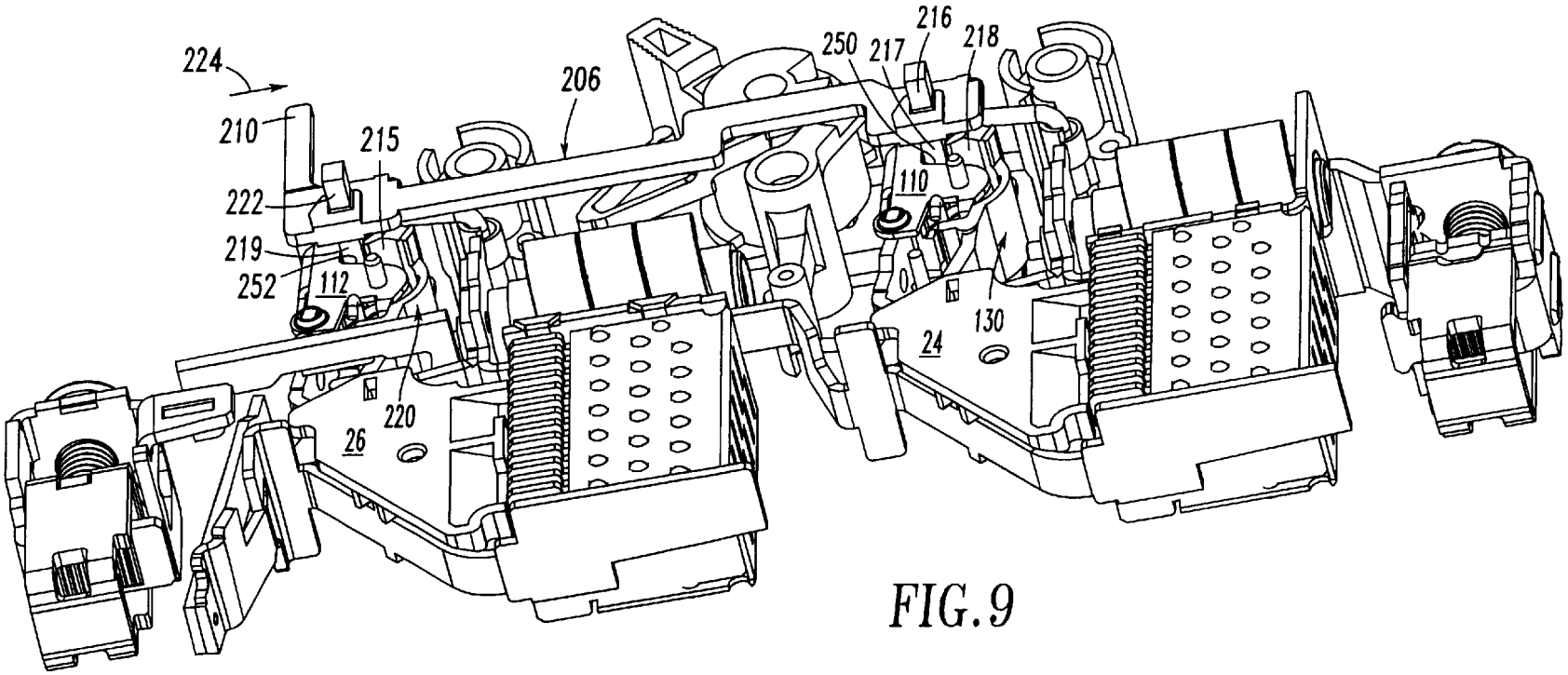
FIG. 9 is an isometric view of one of the trip actuators engaging one of the circuit breaker poles of FIG. 7.

Referring to FIGS. 7 and 9, the upper end 215 of the latch member 220 of the second carrier mechanism 112 is adapted for engagement by a projection 219 of the trip actuator 206. In a related manner, the upper end 218 of the latch member 130 of the first carrier mechanism 110 is adapted for engagement by a projection 217 of the trip actuator 206. Manual movement (as shown by arrow 224 of the push-to-trip pushbutton 210 from the left to the right of FIG. 9) (i.e., from the bottom right to the top left of FIG. 8 as shown by arrow 226) rotates the latch members 130,220 clockwise (with respect to FIG. 9, and counter-clockwise with respect to FIG. 6A for latch member 130). For example, in the first circuit breaker mechanism 24, the hook member 156 of the latch member 130 releases the link end 143. In turn, the carrier mechanism 110 rotates clockwise (with respect to FIG. 5, and counter-clockwise with respect to FIG. 6A) under the bias of spring 132 and the link end 143 (FIG. 2A) moves toward the second end 140 of the channel 137.

As shown in FIG. 2A, the lower end 228 of the first latch member 130 is adapted for engagement by the armature 230 of the first coil 66 of the first magnetic trip circuit. Under predetermined instantaneous current conditions (e.g., greater than about three, seven or twenty times rated current), the current flowing through the coil 66, from the line terminal 16 to the load terminal 10, causes the armature 230 to move to the right on FIG. 2A, engage the lower end 228 of the latch member 130, and rotate the latch member 130 counter-clockwise (with respect to FIGS. 2A and 6A, and clockwise with respect to FIG. 9). In a related manner, the lower end 232 of the second latch member 220 is adapted for engagement by the armature 234 of the coil 68 of the second magnetic trip circuit.

As shown in FIG. 3, the bottom end 236 of the second latch member 220 is adapted for engagement by a shuttle member 238 of the bimetal element 70 of the thermal trip circuit. Under thermal trip conditions, the free end 72 of the bimetal element 70 moves to the right of FIG. 3. In response, the shuttle member 238, which engages the bottom end 236 of the second latch member 220, rotates the latch member 220 counter-clockwise (with respect to FIGS. 2B and 3), in order to trip the second circuit breaker mechanism 26.

As shown in FIG. 9, the trip actuator 206 includes the projections 216 and 222, which respectively engage the upper end projection 214 of the first latch member 130 of the first circuit breaker mechanism 24 and the corresponding upper end projection 242 (shown in FIG. 2B) of the second latch member 220 of the second circuit breaker mechanism 26 of the circuit breaker 202. Similarly, the second trip actuator 208 includes projections 244,246, which engage the upper end projections (not shown) of the latch members (not shown) of the two circuit breaker mechanisms (not shown) of the third circuit breaker 204 of FIG. 7.

As shown in FIG. 7, the circuit breaker 200 is adapted for operation as a first pole of the circuit breaker 2. The trip actuator 206 includes the projections 217,250 and 219,252, which are adapted to interface the two carrier mechanisms 110,112 of the first pole formed by the circuit breaker 200. The trip actuator 206 also includes the projections 216,222, which are adapted to interface the two carrier mechanisms (not shown) of the second pole formed by the circuit breaker 202. It will be appreciated that the second trip actuator 208 operates in an analogous manner with respect to the other two adjacent circuit breakers 202,204.

The projections 216,222,244,246 of the trip actuators 206,208 cooperate with the four carrier mechanisms 110,112 of the circuit breakers 202,204, in order to provide a cascading trip of the four sets of separable contacts 34,40. For example, in response to a thermal trip, magnetic trip or manual trip of the circuit breaker mechanism 24 of the circuit breaker 202, the carrier mechanism 112 rotates clockwise (with respect to FIG. 5, and counter-clockwise with respect to FIG. 6A). As shown in FIG. 6A, the cover portion 116 of the carrier mechanism 112 of the circuit breaker 202 has a projection 248, which engages the projection 216 (shown in phantom line drawing) of the trip actuator 206. In turn, movement of the trip actuator 206 (toward the upper left of FIG. 7) causes the projection 222 to engage the upper end projection 242 (shown in FIG. 2B) of the second latch member 220 and, thereby, trip the second circuit breaker mechanism 26 of the circuit breaker 202.

The trip actuators 206 and 208 also include respective projections 217,219 (as discussed above in connection with FIG. 9) and 221,223, which cooperate with the four carrier mechanisms 110,112 of the circuit breakers 200,202, in order to manually cause the cascading trip of the four sets of separable contacts 34,40.

The trip actuators 206 and 208 further include respective finger projections 250,252 and 254,256, which cooperate with the four carrier mechanisms 110,112 of the circuit breakers 200,202, in order to provide the cascading trip of the four sets of separable contacts 34,40. As shown in FIG. 9, in response to a thermal trip, magnetic trip or manual trip of the first circuit breaker mechanism 24 of the circuit breaker 200, the carrier mechanism 112 rotates clockwise (with respect to FIG. 9, and counter-clockwise with respect to FIG. 6A). This causes the movement of the trip actuator 206 to the right of FIG. 9 as shown by the arrow 224. In turn, the movement of the projection 219 moves the upper portion 215 of the latch member 220, which causes the trip of the circuit breaker mechanism 26 of the circuit breaker 200. Also, the movement of the projections 216 and 222 respectively moves the upper end projection 214 of the latch member 130 of the first circuit breaker mechanism 24 and the upper end projection 242 of the latch member 220 of the second circuit breaker mechanism 26 of the circuit breaker 202. Further, the circuit breaker 202 causes the movement of the trip actuator 208 through the projections 254,256, thereby moving the projections 244,246 to cause the trip of the circuit breaker mechanisms 24,26, respectively, of circuit breaker 204.

Thus, as discussed above, a manual or magnetic trip of one of the six circuit breaker mechanisms 24,26 (or a thermal trip of one of the three circuit breaker mechanisms 26) of the circuit breakers 200,202,204 causes the trip of the other five circuit breaker mechanisms.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

a housing;

a fixed contact;

an operating mechanism including a movable contact arm pivotally mounted thereto and a spring, said movable contact arm having a movable contact adapted for engagement with said fixed contact, said spring biasing said movable contact arm and said movable contact toward said fixed contact;

an operating handle having an OFF position, an ON position, and an intermediate position between said OFF and ON positions, said operating handle including a handle member having an extension;

a blocking member having a bias member, a first surface, a second surface and a third surface, said handle member and said blocking member being co-pivotally mounted to said housing, the extension of said handle member engaging the third surface of said blocking member for rotation therewith;

a pivot lever including a first end adapted for engagement with said movable contact arm, and including a second end adapted for engagement with the first and second surfaces of said blocking member, the first surface of said blocking member blocking the second end of said pivot lever as said operating handle is moved from the OFF position toward the intermediate position thereof, and the first surface of said blocking member releasing the second end of said pivot lever to the second surface of said blocking member as said operating handle is moved to the intermediate position thereof, wherein the first end of said pivot lever blocks movement of said movable contact arm when the first surface of said blocking member blocks the second end of said pivot lever, and wherein the first end of said pivot lever releases said movable contact arm when the first surface of said blocking member releases the second end of said pivot lever as said operating handle is moved to the intermediate position thereof, thereby moving said movable contact arm and said movable contact toward said fixed contact in response to the bias of said spring.

2. The circuit breaker of claim 1 wherein when said fixed and movable contacts are welded closed, the second end of said pivot lever engages the extension of said operating handle and limits rotation of the operating handle from the intermediate position to the OFF position.

3. The circuit breaker of claim 1 wherein said blocking member is a blocking disk; wherein the first surface is a first diameter of the blocking disk; wherein the second surface is a second diameter of the blocking disk; wherein the third surface is between the first and second surfaces; wherein as said operating handle is moved from the OFF position toward the intermediate position thereof, the extension of the handle member engages the third surface of the blocking disk for movement therewith; and wherein the first end of said pivot lever releases said movable contact arm when the first diameter of the blocking disk releases the second end of said pivot lever to the second diameter of the blocking disk as said operating handle is moved to the intermediate position thereof.

4. The circuit breaker of claim 3 wherein said pivot lever includes a first arm having the first end and a second arm having the second end; wherein as said operating handle is moved from the ON position toward the intermediate position thereof, the extension of the handle member engages the second arm of said pivot lever and pivots the first arm and the first end of said pivot lever to engage said movable contact arm for movement of the movable contact thereof away from said fixed contact.

5. The circuit breaker of claim 1 wherein the first end of said pivot lever has a hook, which is adapted for engagement with said movable contact arm.

6. The circuit breaker of claim 1 wherein the first end of said pivot lever has a hook member pivotally disposed thereon, said hook member having a hook which is adapted for blocking and releasing said movable contact arm.

* * * * *